US011089852B2

(12) United States Patent
Wu

(10) Patent No.: US 11,089,852 B2
(45) Date of Patent: Aug. 17, 2021

(54) RETRACTABLE WHEEL MECHANISM OF A SUITCASE

(71) Applicant: Yi-Ming Wu, Taipei (TW)

(72) Inventor: Yi-Ming Wu, Taipei (TW)

( * ) Notice: Subject to any disclaimer, the term of this patent is extended or adjusted under 35 U.S.C. 154(b) by 448 days.

(21) Appl. No.: 16/258,510

(22) Filed: Jan. 25, 2019

(65) Prior Publication Data

US 2020/0237065 A1 Jul. 30, 2020

(51) Int. Cl.
*A45C 5/14* (2006.01)

(52) U.S. Cl.
CPC ..... *A45C 5/146* (2013.01)

(58) Field of Classification Search
CPC .. A45C 1/146; A45C 13/262; A45C 2013/267
See application file for complete search history.

(56) References Cited

U.S. PATENT DOCUMENTS 7,861,834 B2 * 1/2011 Gorga ..... A45C 5/146 190/18 A
9,433,270 B2 * 9/2016 D'Angelo ..... A45C 13/262
2004/0163910 A1 * 8/2004 Lee ..... A45C 5/146 190/18 A
2007/0039794 A1 * 2/2007 Hwang ..... A63B 55/40 190/18 A
2012/0261223 A1 * 10/2012 Pattni ..... A45C 5/14 190/18 A
2013/0186723 A1 * 7/2013 D'Angelo ..... A45C 5/146 190/18 A
2015/0342318 A1 * 12/2015 Arthur ..... A45C 5/146 280/655.1
2019/0000198 A1 * 1/2019 Wu ..... A45C 5/146
2020/0390208 A1 * 12/2020 Shah ..... A45C 13/262

* cited by examiner

*Primary Examiner* — Victor D Batson
*Assistant Examiner* — Matthew J Sullivan
(74) *Attorney, Agent, or Firm* — Snell & Wilmer L.L.P.

(57) ABSTRACT

A retractable wheel mechanism of a suitcase has a main housing, a retractable handle mounted in the main housing, two slidable panels mounted separately in the main housing, and two wheel sets separately mounted in the main housing. By extending or shortening the retractable handle, the slidable panels are driven to slide transversely and drive the wheel sets to protrude out of the main housing or to be retracted in the main housing. An owner of the suitcase can retract the wheel sets whenever he has to carry the suitcase without dirty his clothes, or whenever he has to pull the suitcase into an office or a room without revealing the dirty wheel. Moreover, an appearance of the suitcase becomes compact when the wheel sets are retracted.

16 Claims, 15 Drawing Sheets

RETRACTABLE WHEEL MECHANISM OF A SUITCASE

BACKGROUND OF THE INVENTION

1. Field of the Invention

The present invention relates to a wheel mechanism of a suitcase, especially to a retractable wheel mechanism of a suitcase.

2. Description of the Prior Art(s)

A suitcase is used for holding a traveler's clothing and other personal articles while the traveler is in transit. Therefore, the suitcase is an almost indispensable part of traveling.

A conventional suitcase includes a main case for holding articles. For the convenience of moving the main case, the conventional suitcase further includes a handle and two wheels. The handle is mounted on a top of the main case and may be retractable. The two wheels are separately fixed on and protrude down from a bottom of the main case. When the traveler holds the handle to pull the conventional suitcase, the wheels roll on the ground, so as to allow the traveler to easily move the conventional suitcase.

However, since the wheels roll on the ground while moving the conventional suitcase, the wheels are dusted with dust and are dirty. Consequently, when the traveler has to carry the conventional suitcase, the wheels, which remain protruding on the bottom of the main case, dirty the traveler's clothes. Moreover, when the traveler goes on a business trip, it is impolite to pull the conventional suitcase with the dirty wheels exposing outside the conventional suitcase into an office of who he meets.

In addition, the wheels that expose outside the conventional suitcase elongate a height of the conventional suitcase, causing the conventional suitcase to take up much space in a closet. Accordingly, the conventional suitcase is inconvenient for storage.

To overcome the shortcomings, the present invention provides a retractable wheel mechanism of a suitcase to mitigate or obviate the aforementioned problems.

SUMMARY OF THE INVENTION

The main objective of the present invention is to provide a retractable wheel mechanism of a suitcase. The retractable wheel mechanism has a main housing, a retractable handle, two slidable panels, and two wheel sets.

The main housing has two openings and two wheel storage portions. The wheel storage portions are separately defined in the main housing and correspond in position to and communicates with the openings respectively.

The retractable handle is mounted on the main housing and has two retractable rod assemblies. The retractable rod assemblies are mounted through the main housing. Each of the retractable rod assemblies includes a driving protrusion driven and a restoring resilient element mounted in the retractable rod assembly and abutting against the driving protrusion. The driving protrusion is driven to slide longitudinally when the retractable rod assembly retracts or extends.

The two slidable panels are mounted separately in the main housing, and are respectively driven by the driving protrusions of the retractable rod assemblies to slide transversely.

The two wheel sets are respectively mounted in the wheel storage portions and are respectively driven by the slidable panels to selectively be retracted in the main housing and protrude out of the main housing.

By extending or shortening the retractable rod assemblies, the wheel sets can be driven to protrude out of the main housing or can be retracted to be stored in the main housing. An owner of the suitcase with the retractable wheel mechanism can retract the wheel sets whenever he has to carry the suitcase without dirty his clothes, or whenever he has to pull the suitcase into an office or a room without revealing the dirty wheel. Moreover, when the wheel sets are retracted, an appearance of the suitcase becomes a rectangular cuboid. Accordingly, the suitcase can be compactly stored in a closet.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
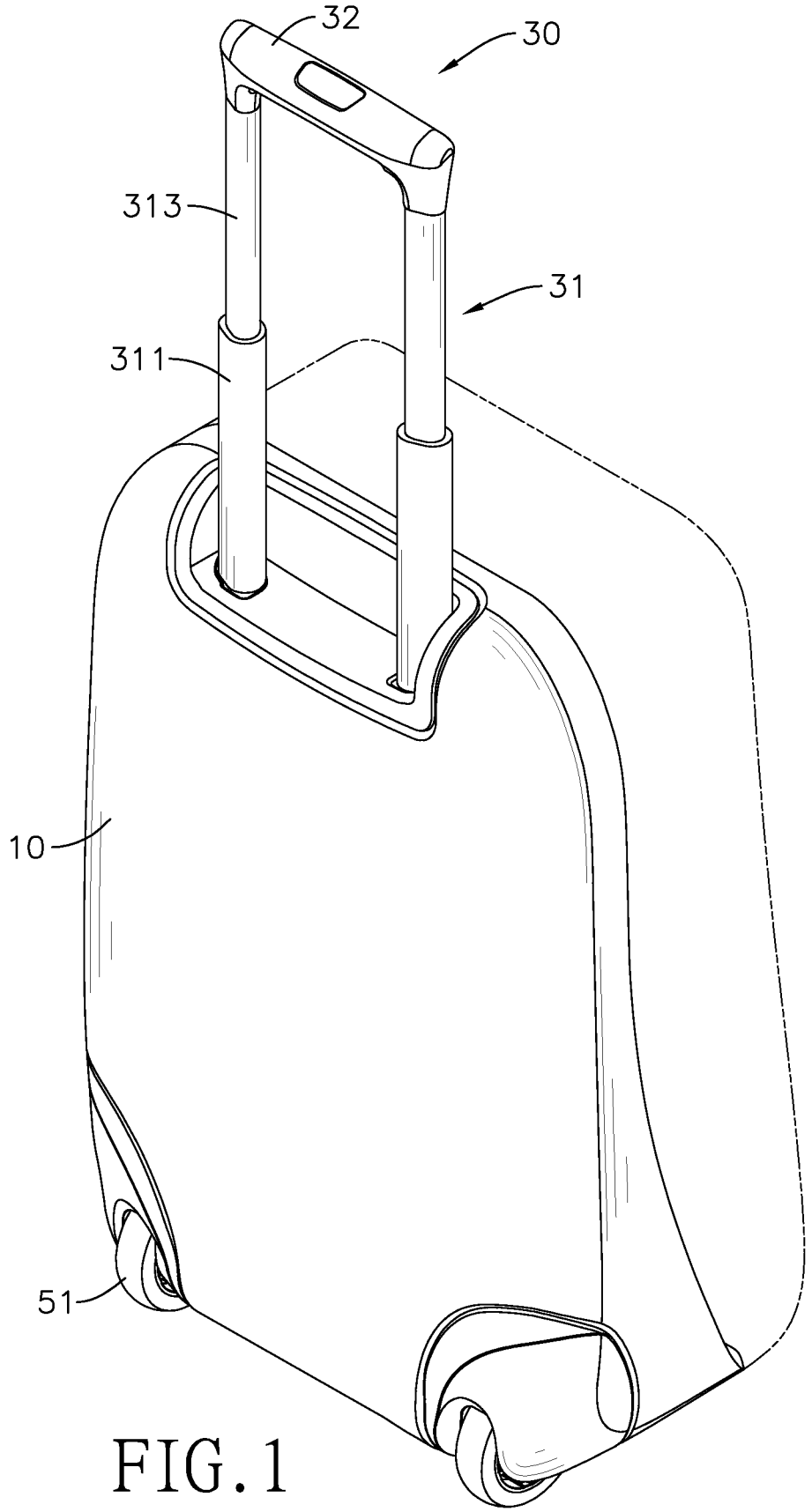
FIG. 1 is a perspective view of a retractable wheel mechanism of a suitcase in accordance with the present invention.
Figure 2:
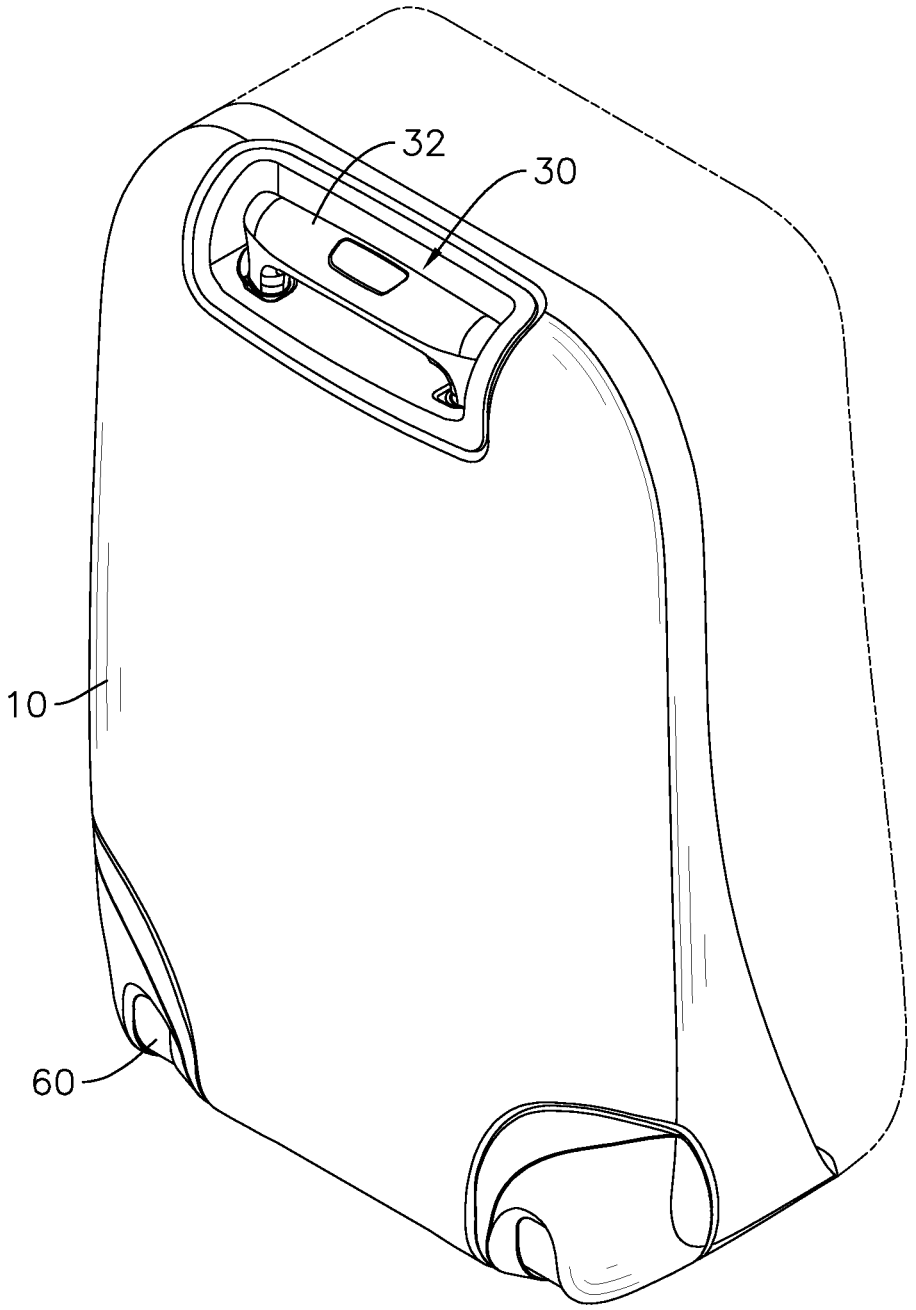
FIG. 2 is a perspective view of the retractable wheel mechanism of the suitcase in FIG. 1, showing a retractable handle and two wheels being retracted.
Figure 3:
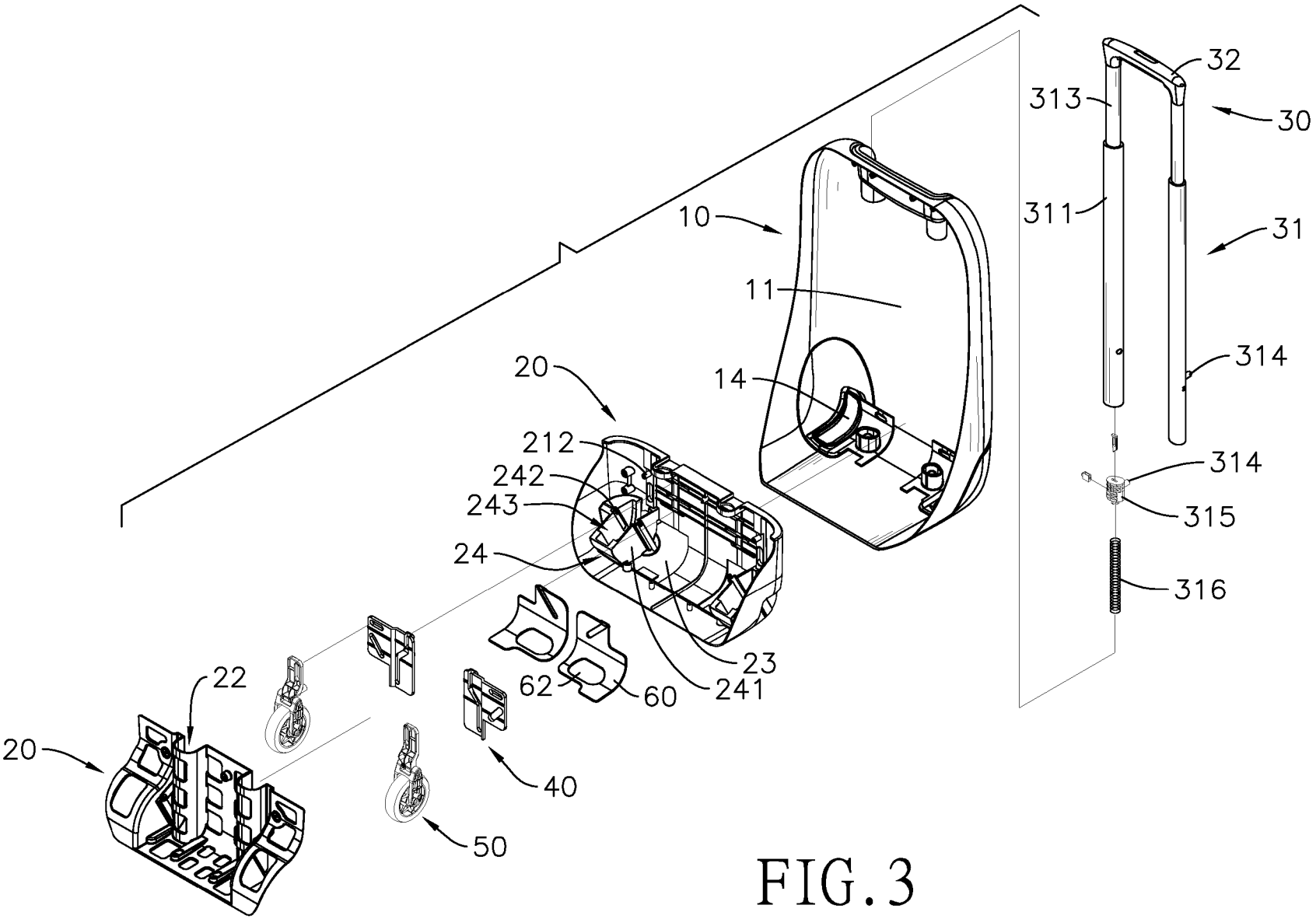
FIG. 3 is an exploded perspective view of the retractable wheel mechanism of the suitcase in FIG. 1.

With reference to FIGS. 1 to 3, a retractable wheel mechanism of a suitcase in accordance with the present invention comprises a main housing, a retractable handle 30, two slidable panels 40, two wheel sets 50, and two wheel covers 60.

The main housing 10 includes an outer housing 10 and a wheel housing 20.

Figure 5:
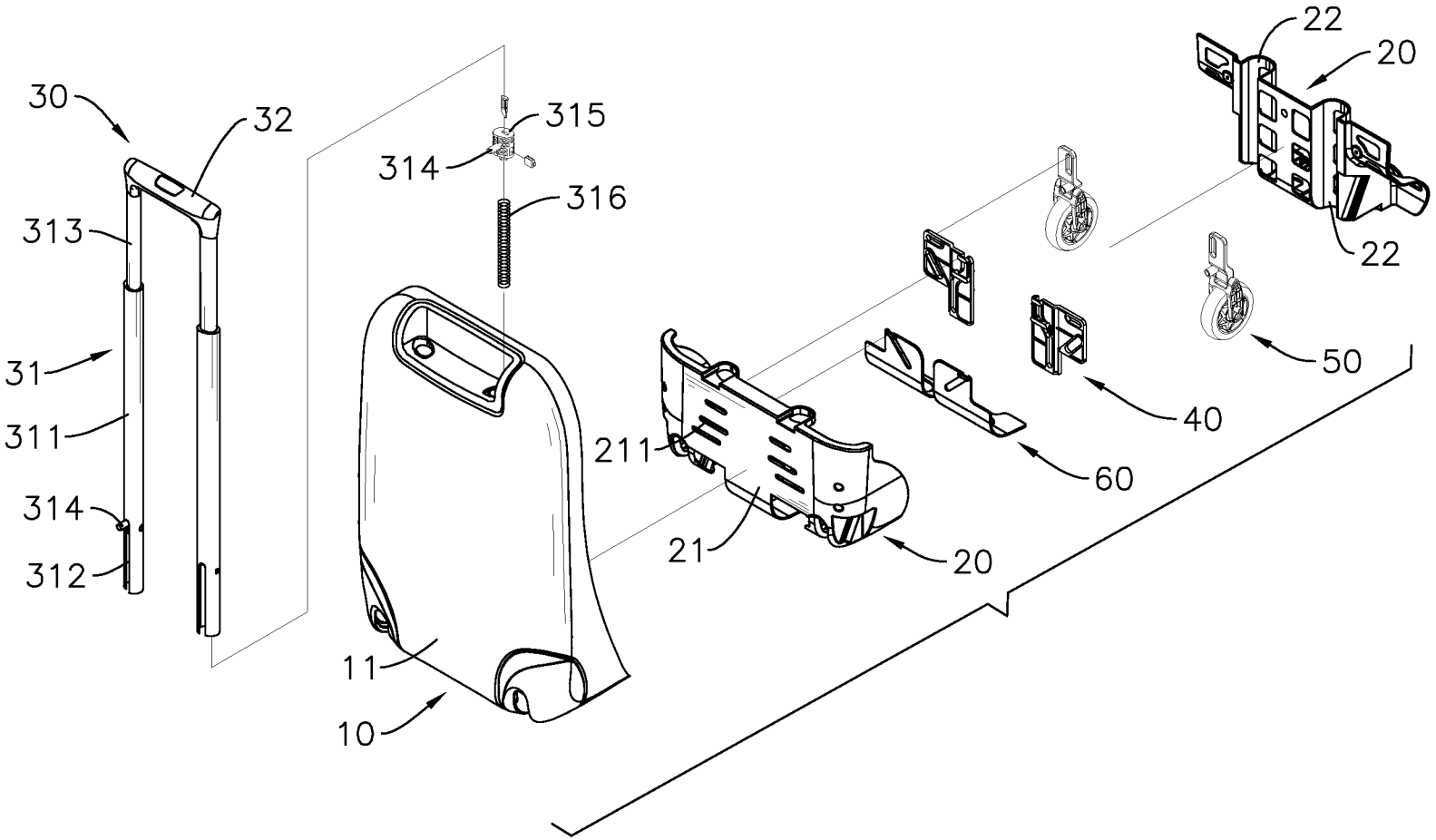
FIG. 5 is another exploded perspective view of the retractable wheel mechanism of the suitcase in FIG. 1.

With reference to FIGS. 3 and 5, the outer housing 10 has a side board 11 and two openings 14. The side board 11 is a middle part of the outer housing 10 and has an upper end, a lower end, and two opposite sides. The two openings 14 are separately formed through the outer housing 10 of the main housing.

As shown in FIGS. 3 and 5, the wheel housing 20 may be formed by attaching two half-housings, is securely mounted in an interior of the outer housing 10 and has a wheel mount 21, multiple transverse guide slots 211, multiple guiding protrusions 212, two longitudinal channels 22, two through holes 23, and two wheel storage portions 24.

The wheel mount 21 is disposed next to and is attached to the side board 11 of the outer housing 10. The transverse guide slots 211 of the wheel housing 20 are separately formed in the wheel mount 21 of the wheel housing 20. Each of the transverse guide slots 211 of the wheel housing 20 has two ends respectively extending toward the two opposite sides of the side board 11 of the outer housing 10. The guiding protrusions 212 of the wheel housing 20 separately protrude from the wheel mount 21 toward an interior of the wheel housing 20.

The longitudinal channels 22 are separately defined in the wheel housing 20 and extend parallel to each other. The two through holes 23 of the wheel housing 20 are separately formed through the wheel housing 20.

The wheel storage portions 24 are separately defined in the wheel housing 20 of the main housing, and correspond in position to and communicate with the openings 14 of the outer housing 10 respectively. Each of the wheel storage portions 24 has two side walls 241 and a wheel storage chamber 243. The side walls 241 are separately disposed. Each of the side walls 241 has a wheel guiding slot 242. The wheel guiding slot 242 is formed in the side wall 241, extends obliquely, and is parallel with the wheel guiding slot 242 of the other side wall 241. Specifically, a lower end of the wheel guiding slot 242 extends toward the wheel mount 21 and the side board 11, and an upper end of the wheel guiding slot 242 extends to depart from the wheel mount 21 and the side board 11. The wheel storage chamber 243 is defined between the two side walls 241, is defined through the wheel housing 20, and communicates with a corresponding one of the openings 14 of the outer housing 10.

As shown in FIGS. 3 and 5, the retractable handle 30 is mounted on the outer housing 10 of the main housing and has two retractable rod assemblies 31 and a grip 32.

The two retractable rod assemblies 31 are mounted through the outer housing 10 of the main housing and protrude in the longitudinal channels 22 of the wheel housing 20 respectively. Each of the retractable rod assemblies 31 includes an outer tube 311, an inner tube 313, a driving protrusion 314, and a restoring resilient element 316.

The outer tube 311 is securely mounted in outer housing 10 and has an upper end, a lower end, and a longitudinal guide slot 312. The upper end of the outer tube 311 is connected to the outer housing 10, and communicates with an exterior of the outer housing 10. The lower end of the outer tube 311 is mounted through a corresponding one of the through holes 23 of the wheel housing 20 and is connected to the outer housing 10. As shown in FIG. 5, the longitudinal guide slot 312 of the outer tube 311 is formed through the outer tube 311 and has two ends respectively extending toward the upper end of the outer tube 311 and the lower end of the outer tube 311.

The inner tube 313 is slidably mounted in the outer tube 311 and has an upper end and a lower end. The upper end of the inner tube 313 protrudes out of the upper end of the outer tube 311. The lower end of the inner tube 313 is positioned toward the lower end of the outer tube 311. The driving protrusion 314 is driven to slide longitudinally when the retractable rod assembly retracts or extends. The restoring resilient element 316 is mounted in the retractable rod assembly 31 and abuts against the driving protrusion 314. Specifically, the driving protrusion 314 is securely mounted on and protrudes from the inner tube 313, and protrudes through the longitudinal guide slot 312 of the outer tube 311. The restoring resilient element 316 is mounted in the outer tube 311 and the inner tube 313 and has two ends respectively abutting against the outer housing 10 and the driving protrusion 314. Specifically, the restoring resilient element 316 is a compression spring. In the preferred embodiment, the driving protrusion 314 is securely mounted on the inner tube 313 by attaching to a fixed block 315. The fixed block 315 is securely mounted in the inner tube 313.

The grip 32 is securely connected to the upper ends of the inner tubes 313 of the two retractable rod assemblies 31.

Figure 4:
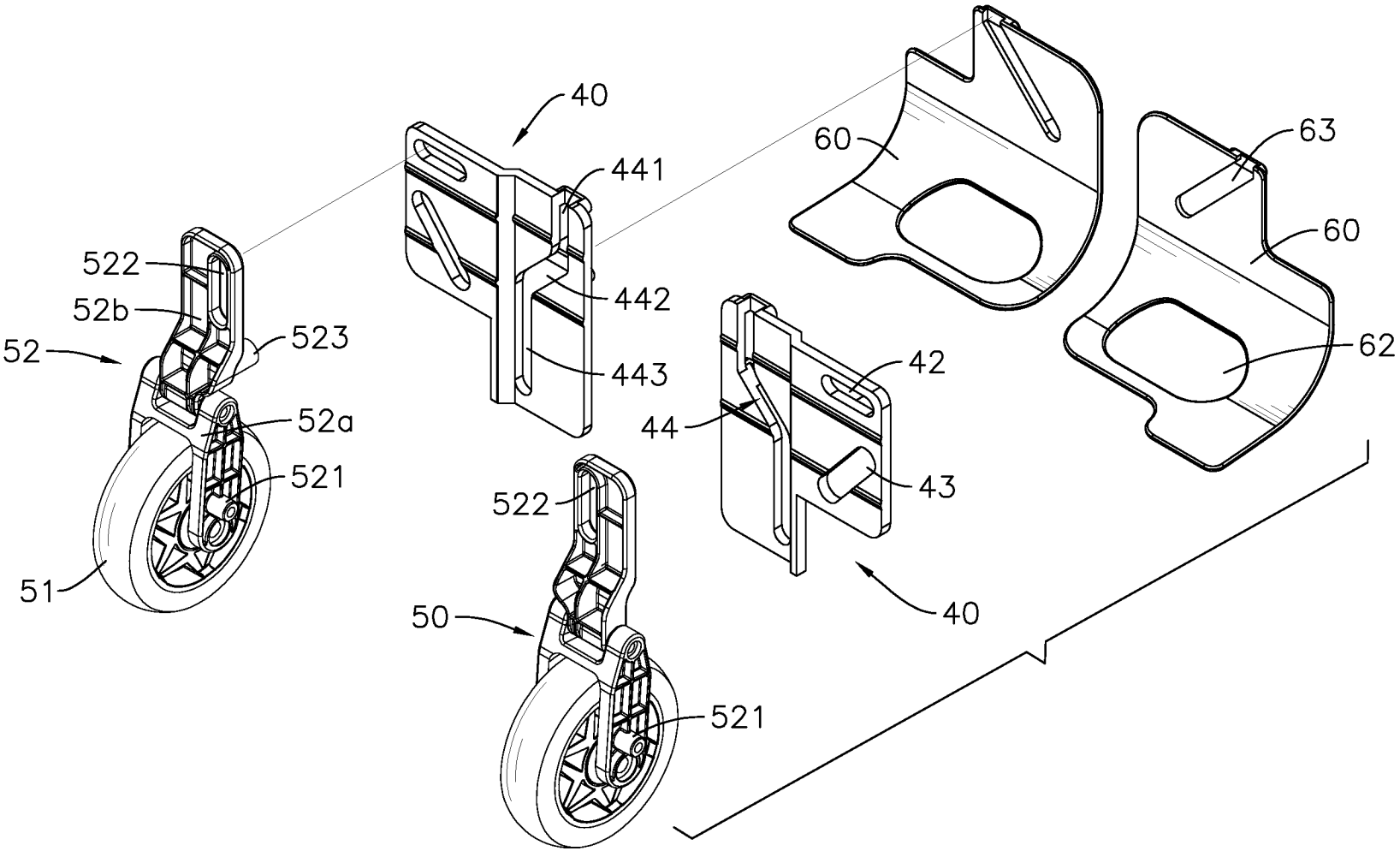
FIG. 4 is a partially enlarged exploded perspective view of the retractable wheel mechanism of the suitcase in FIG. 3.
Figure 6:
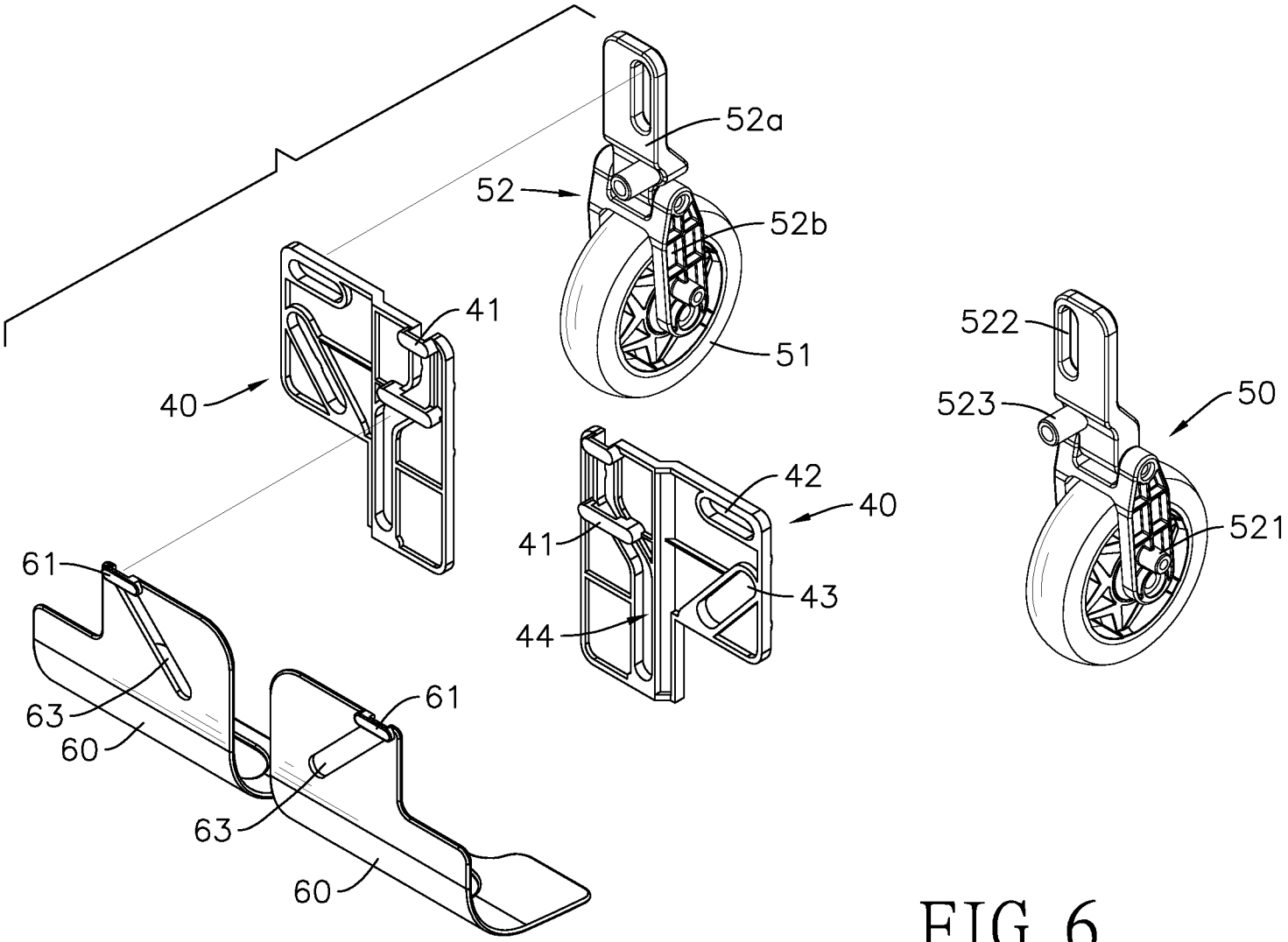
FIG. 6 is a partially enlarged exploded perspective view of the retractable wheel mechanism of the suitcase in FIG. 5.
Figure 7:
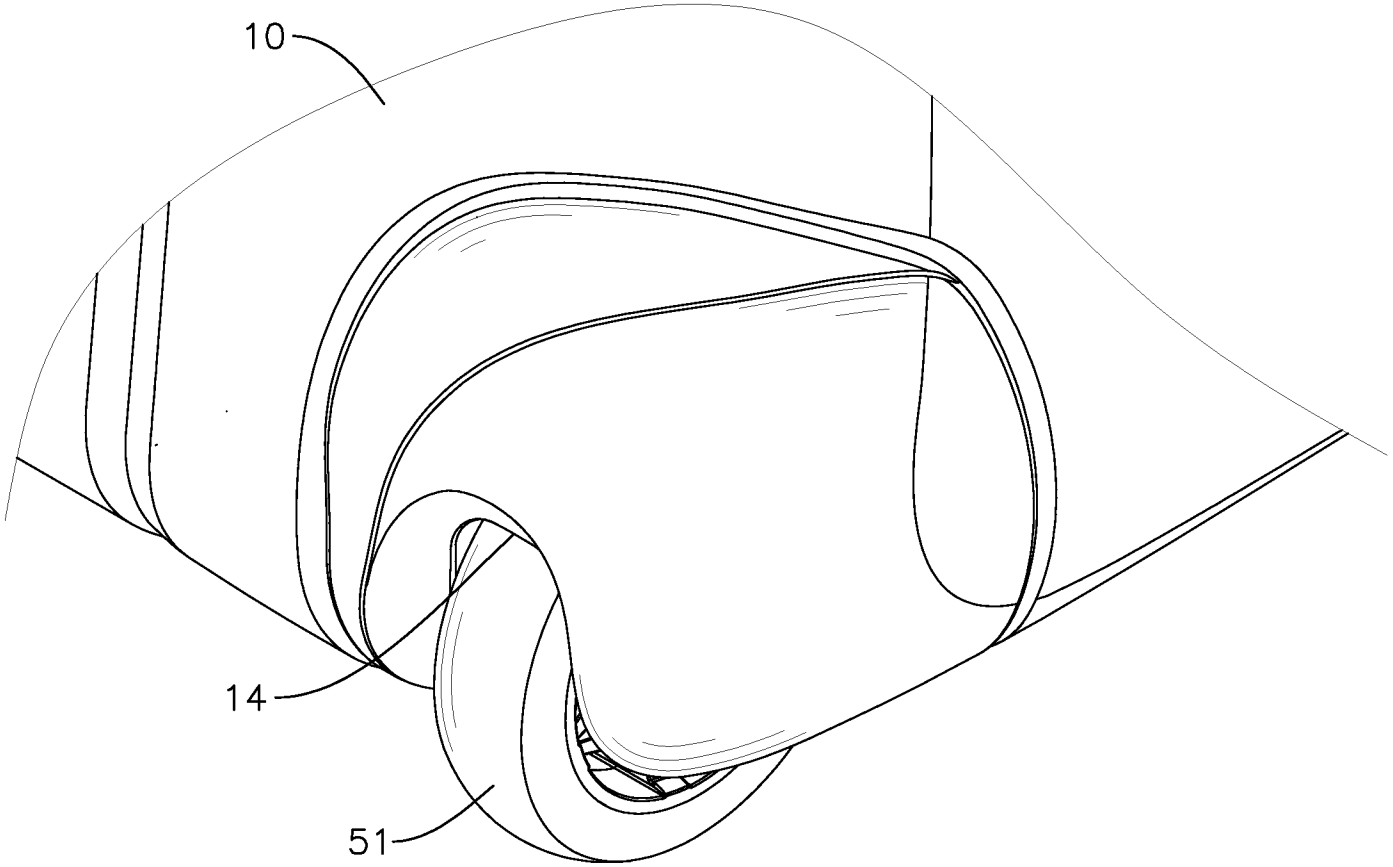
FIG. 7 is an enlarged perspective view of the retractable wheel mechanism of the suitcase in FIG. 1, showing a wheel protruding out of an outer housing.
Figure 8:
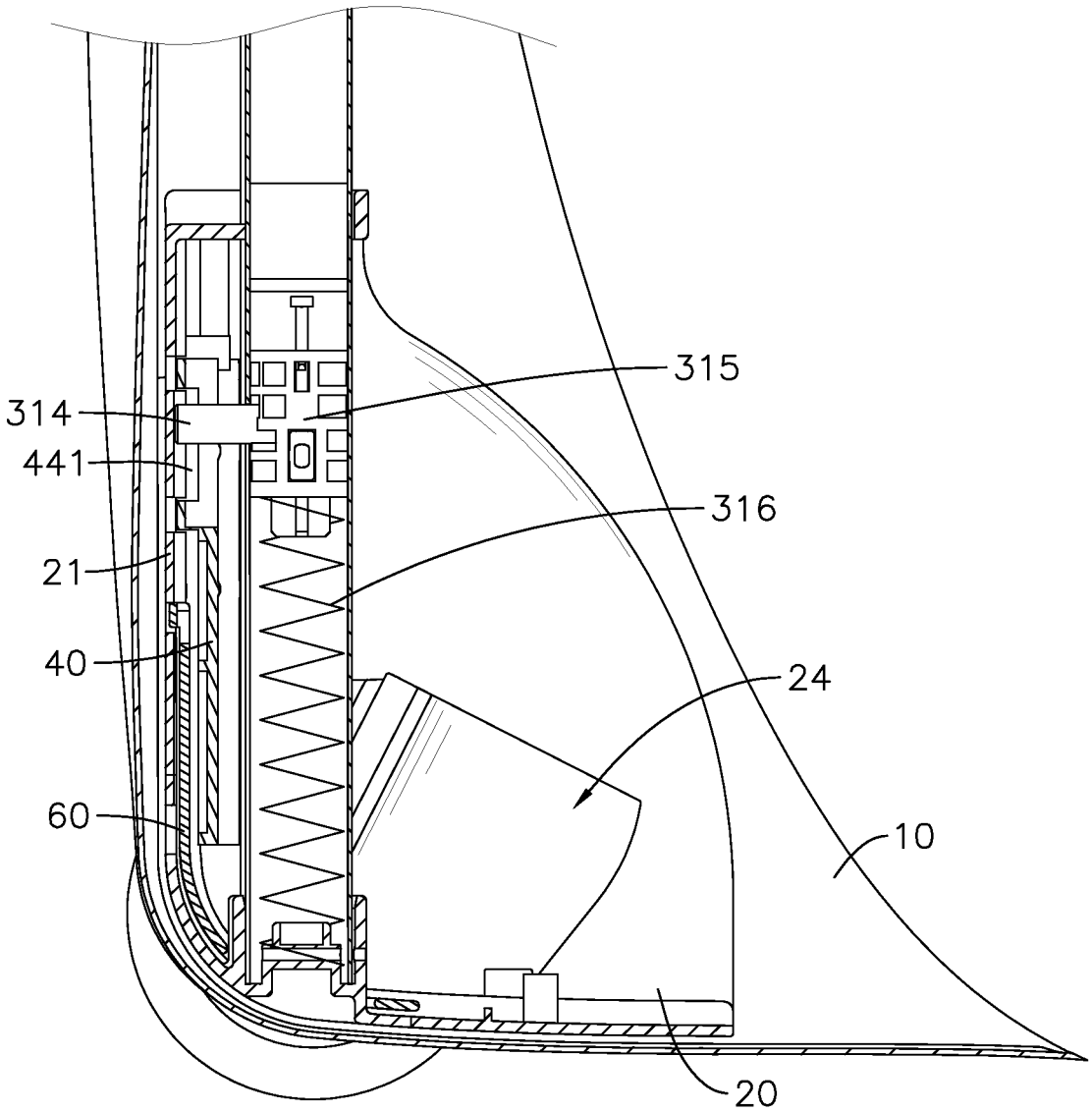
FIG. 8 is an enlarged cross-sectional side view of the retractable wheel mechanism of the suitcase in FIG. 7.
Figure 9:
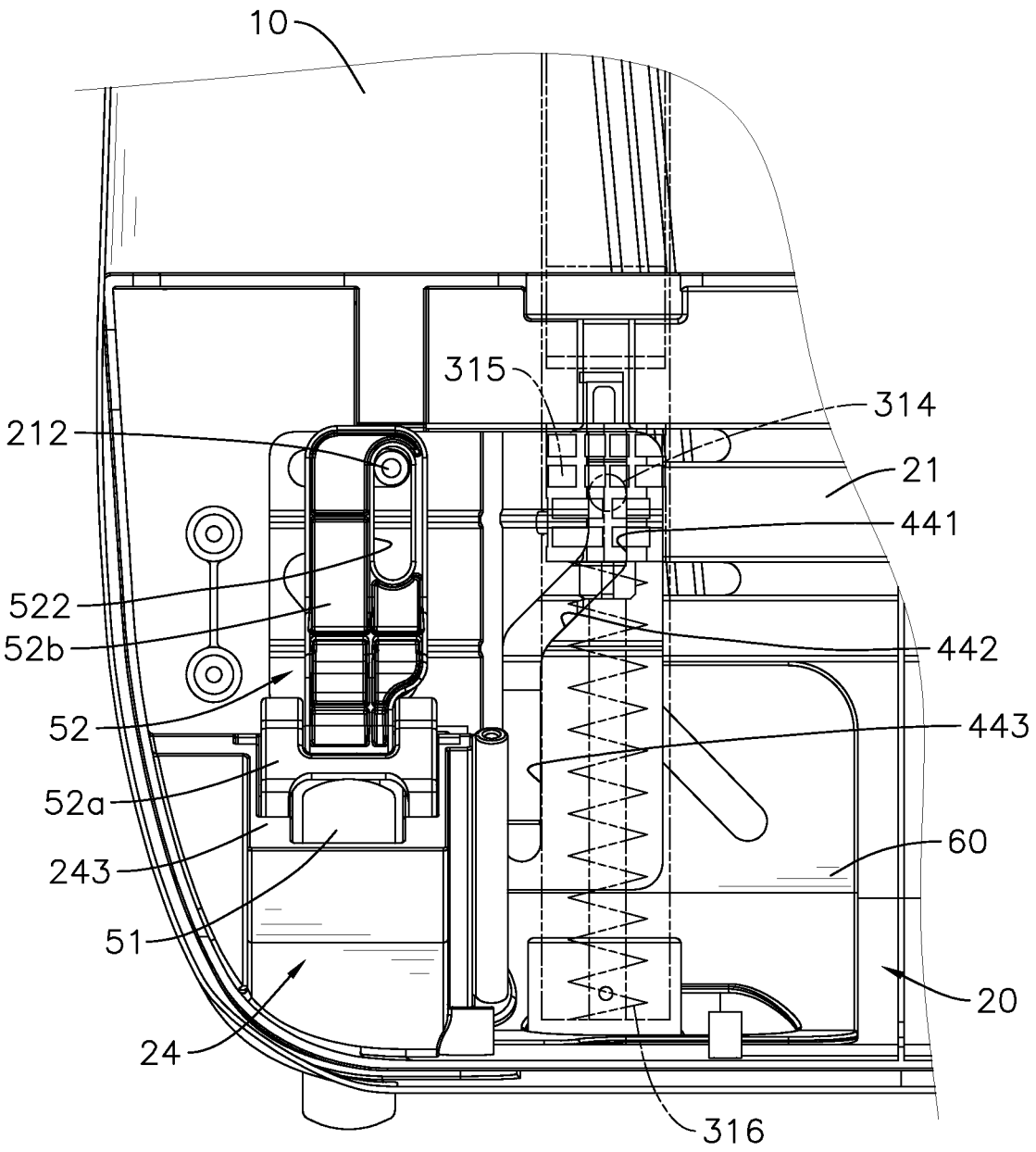
FIG. 9 is an enlarged schematic view of the retractable wheel mechanism of the suitcase in FIG. 7.

Furthermore, the above-mentioned inner tube 313 of each retractable rod assembly 31 may be one-stage telescopic or multi-stage telescopic. Thus, a length of the retractable handle 30 can be adjusted, so as to meet the needs of different users' in different situation. With further reference to FIGS. 4 and 6, the two slidable panels 40 are mounted separately in the wheel housing 20 of the main housing and are respectively driven by the driving protrusions 314 of the retractable rod assemblies 31 to slide transversely. Each of the slidable panels 40 has an inner side edge, an outer side edge, at least one sliding protrusion 41, a transverse guide slot 42, a driving slot 43, and a driven slot 44.

The inner side edge of the slidable panel 40 is disposed next to the inner side edge of the other slidable panel 40. The outer side edge of the slidable panel 40 is disposed opposite to the inner side edge of the slidable panel 40.

Each of the at least one sliding protrusion 41 of the slidable panel 40 protrudes into a corresponding one of the transverse guiding slots 211 of the wheel housing 20. The transverse guide slot 42 of the slidable panel 40 is formed in the slidable panel 40 and has two ends respectively extending toward the two opposite sides of the side board 11 of the outer housing 10. Each guiding protrusions 212 of the wheel housing 20 protrudes into the transverse guide slot 42 of a corresponding one of the slidable panels 40. Thus, the slidable panels 40 are restricted to be able to transversely slide relative to the wheel housing 20 only.

The driving slot 43 is formed in the slidable panel 40 and extends obliquely. Specifically, a lower end of the driving slot 43 extends toward the inner side edge of the slidable panel 40 and an upper end of the driving slot 43 extends toward the outer side edge of the driving panel 40.

The driven slot 44 is formed in the slidable panel 40 and has an upper longitudinal section 441, a shifting section 442, and a lower longitudinal section 443. The upper longitudinal section 441 extends longitudinally. The shifting section 442 extends obliquely down from a lower end of the upper longitudinal section 441. Specifically, an upper end of the shifting section 442 extends toward the inner side edge of the slidable panel 40, and is connected to and communicates with the lower end of the upper longitudinal section 441; and a lower end of the shifting section 442 extends toward the outer side edge of the slidable panel 40. The lower longitudinal section 443 extends longitudinally down from the lower end of the shifting section and is parallel with the upper longitudinal section 441. An upper end of the lower longitudinal section 443 is connected and communicates with the lower end of the shifting section 442. The driving protrusion 314 of a corresponding one of the retractable rod assemblies 31 protrudes in the driven slot 44 of the slidable panel 40.

The two wheel sets 50 are respectively mounted in the wheel storage chamber 243 of the wheel housing 20 and are respectively driven by the slidable panels 40 to selectively be retracted in the wheel housing 20 of the main housing and protrude out of the wheel housing 20 and the outer housing 10 of the main housing. Each of the wheel sets 50 has a wheel 51 and a connector 52. The wheel 51 has a central rotating shaft. The connector 52 is rotatably connected to the central rotating shaft of the wheel 51 and has a longitudinal guide slot 522 and a driven protrusion 523. The longitudinal guide slot 522 of the connector 52 is formed through the connector 52 and aligns with the transverse guide slot 42 of a corresponding one of the slidable panel 40. The guiding protrusion 212 of the wheel housing 20, which protrudes in the transverse guide slot 42 of the corresponding slidable panel 40, further protrudes in the longitudinal guide slot 523 of the connector 52. The driven protrusion 523 of the connector 52 protrudes toward the wheel mount 21 of the wheel housing 20 and protrudes into the driving slot 43 of the corresponding slidable panel 40.

In the preferred embodiment, the connector 52 of each of the wheel sets 50 includes a lower bracket 52*a* and an upper bracket 52*b*. The lower bracket 52*a* is rotatably connected to two opposite ends of the central rotating shaft of the wheel 51 and has two guiding protrusions 521. The two guiding protrusions 521 of the lower bracket 52*a* protrude into the wheel guiding slots 242 on the side walls 241 of the wheel storage portion 24 respectively. The upper bracket 52*b* is rotatably connected to the lower bracket 52. A rotation axis of the upper bracket 52*b* is parallel to the central rotating shaft of the wheel 51. The longitudinal guide slot 522 of the connector 52 and the driven protrusion 523 of the connector 52 are formed on the upper bracket 52*b*.

The two wheel covers 60 are slidably mounted separately in the wheel housing 20, respectively correspond in position to the slidable panels 40, and selectively cover the through holes 23 of the wheel housing 20 respectively. As the wheel covers 60 cover the through holes 23 of the wheel housing 20, the wheel covers 60 also cover the openings 14 of the outer housing 10. Each of the wheel covers 60 is disposed between the wheel mount 21 and a corresponding one of the slidable panels 40, and has at least one sliding protrusion 61, a transverse guide slot 62, and a driven slot 63.

Each of the at least one sliding protrusion 61 of the wheel cover 60 protrudes into a corresponding one of the transverse guiding slots 211 of the wheel housing 20. The transverse guide slot 62 of the wheel cover 60 is formed through the wheel cover 60. The outer tube 311 of a corresponding one of the retractable rod assemblies 31 is mounted through the transverse guiding slot 62 of the wheel cover 60.

The driven slot 63 of the wheel cover 60 is formed in the wheel cover 60, extends obliquely and is formed through an upper edge of the wheel cover 60. Specifically, an upper end of the driven slot 63 of the wheel cover 60 is formed through the upper edge of the wheel cover 60 and corresponds in position to the upper end of the lower longitudinal section 443 of the driven slot 44 of the corresponding slidable panel 40; and a lower end of the driven slot 63 of the wheel cover 60 extends to depart from the lower longitudinal section 443 of the driven slot 44 of the corresponding slidable panel 40. When the driving protrusion 314 of the corresponding retractable rod assembly 31 slides to the lower longitudinal section 443 of the driven slot 44 of the corresponding slidable panel 40, the driving protrusion 314 of the corresponding retractable rod assembly 31 also protrudes in and slides along the driven slot 63 of the wheel cover 60. Thus, the wheel covers 60 are driven to transversely slide in the wheel housing 20, so as to selectively cover the through holes 23 of the wheel housing 20 respectively.

With reference to FIGS. 1, 7, 8, and 9, when the inner tubes 313 of the retractable rod assemblies 31 extend out of the outer tubes 311, the driving protrusion 314 of each of the retractable rod assemblies 31 is disposed in the upper longitudinal section 441 of the driven slot 44 of the corresponding slidable panel 40. For the time being, the driven protrusion 523 of the connector 52 of each of the wheel sets 50 is disposed at the lower end of the driving slot 43 of the corresponding slidable panel 40, and the guiding protrusions 521 of the connector 52 of each of the wheel sets 50 is disposed at the lower ends of the wheel guiding slots 242 on the side walls 241 of the corresponding wheel storage portion 24. Meanwhile, the wheel covers 60 do not cover the through holes 23 of the wheel housing 20 and the openings 14 of the outer housing 10.

Figure 10:
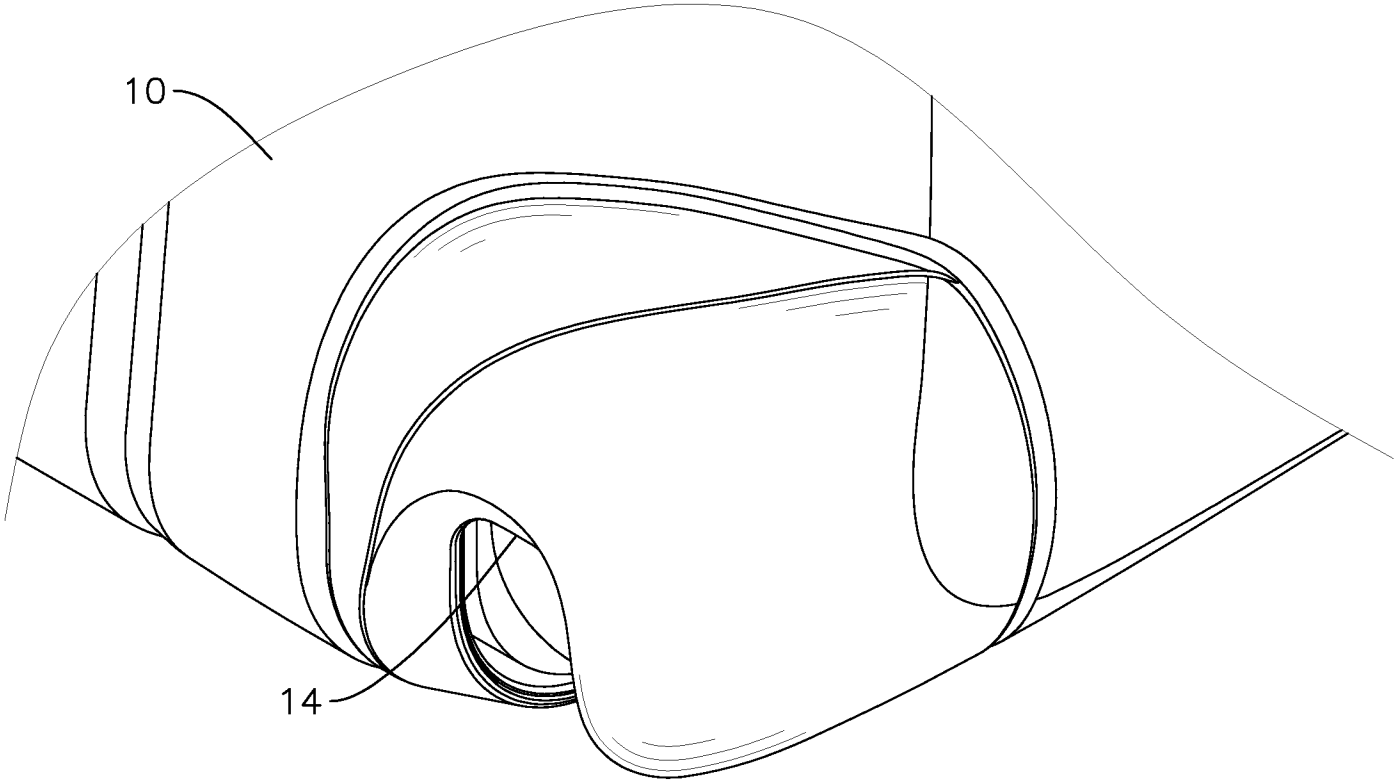
FIG. 10 is an enlarged perspective view of the retractable wheel mechanism of the suitcase in FIG. 1, showing the wheel being retracted to be stored in the outer housing.
Figure 11:
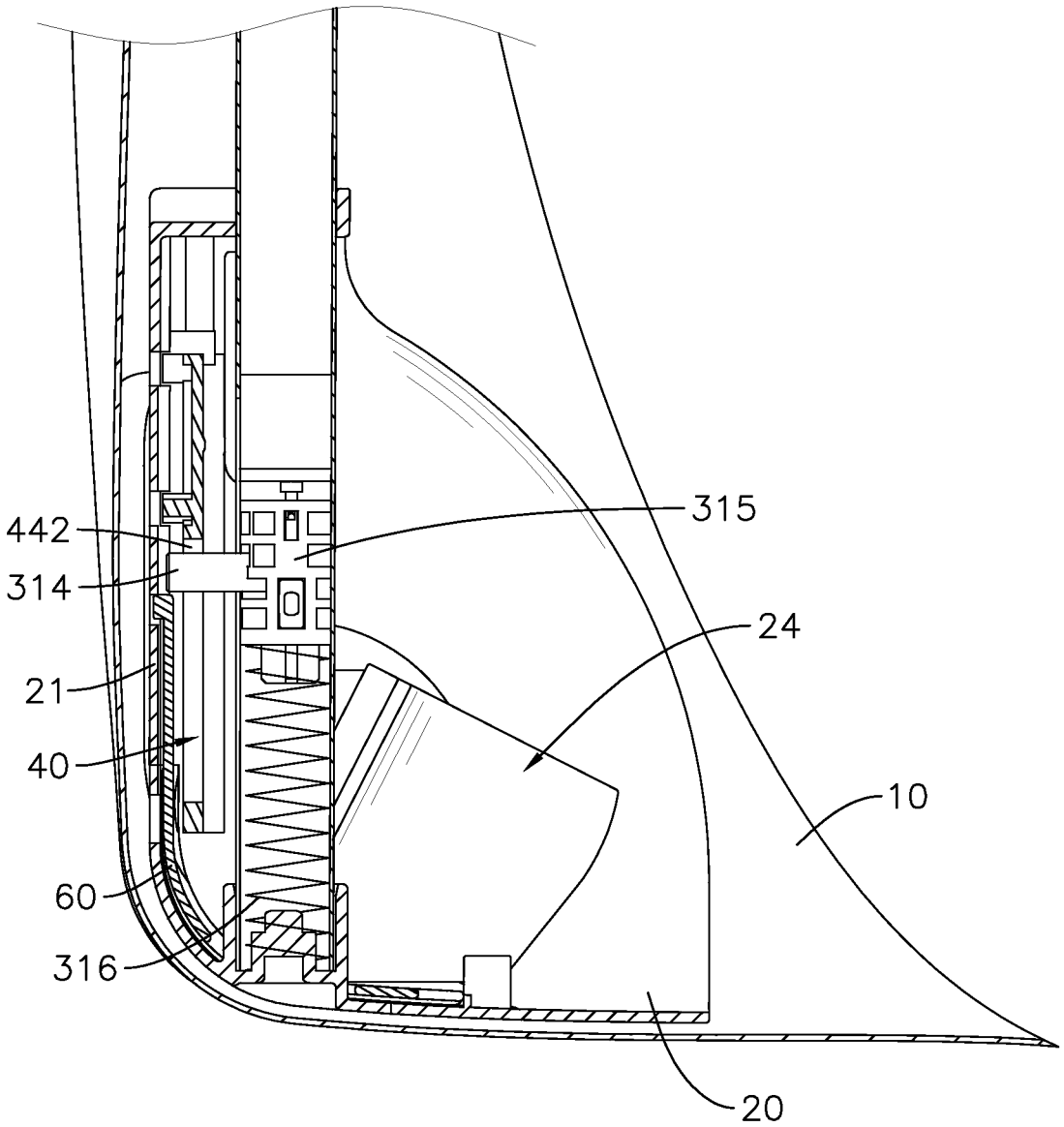
FIG. 11 is an enlarged cross-sectional side view of the retractable wheel mechanism of the suitcase in FIG. 10.
Figure 12:
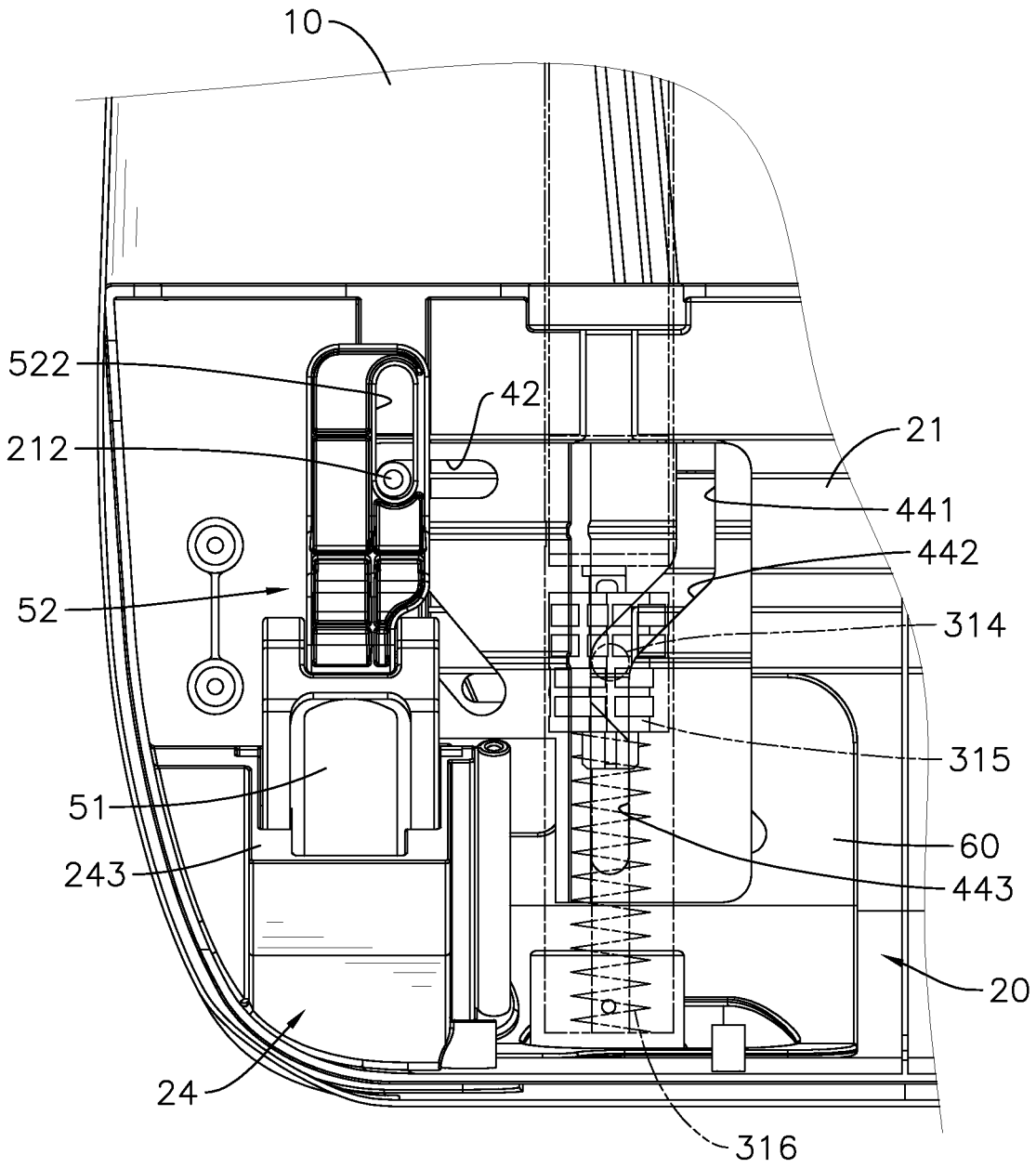
FIG. 12 is an enlarged schematic view of the retractable wheel mechanism of the suitcase in FIG. 10.
Figure 13:
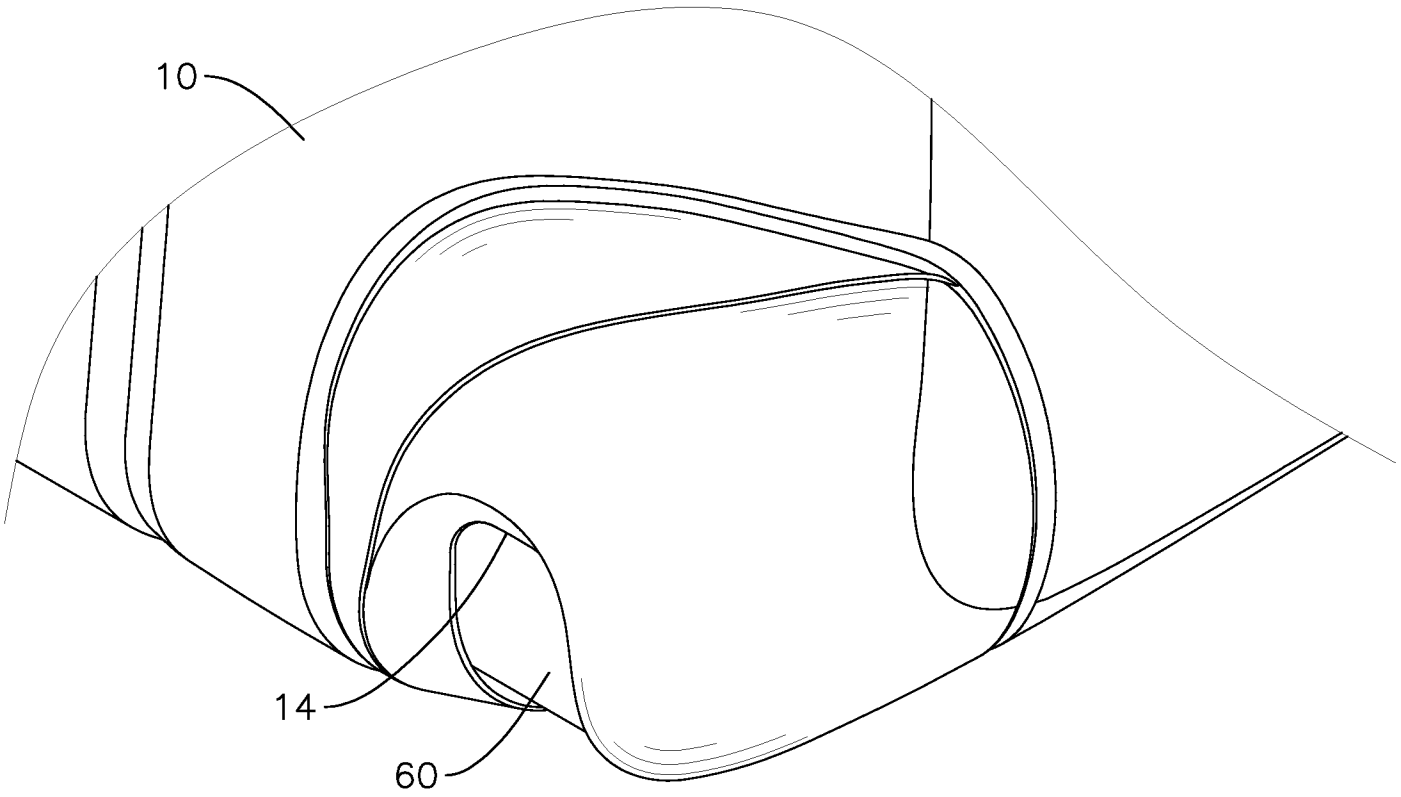
FIG. 13 is an enlarged perspective view of the retractable wheel mechanism of the suitcase in FIG. 2, showing a cover covering the wheel.
Figure 14:
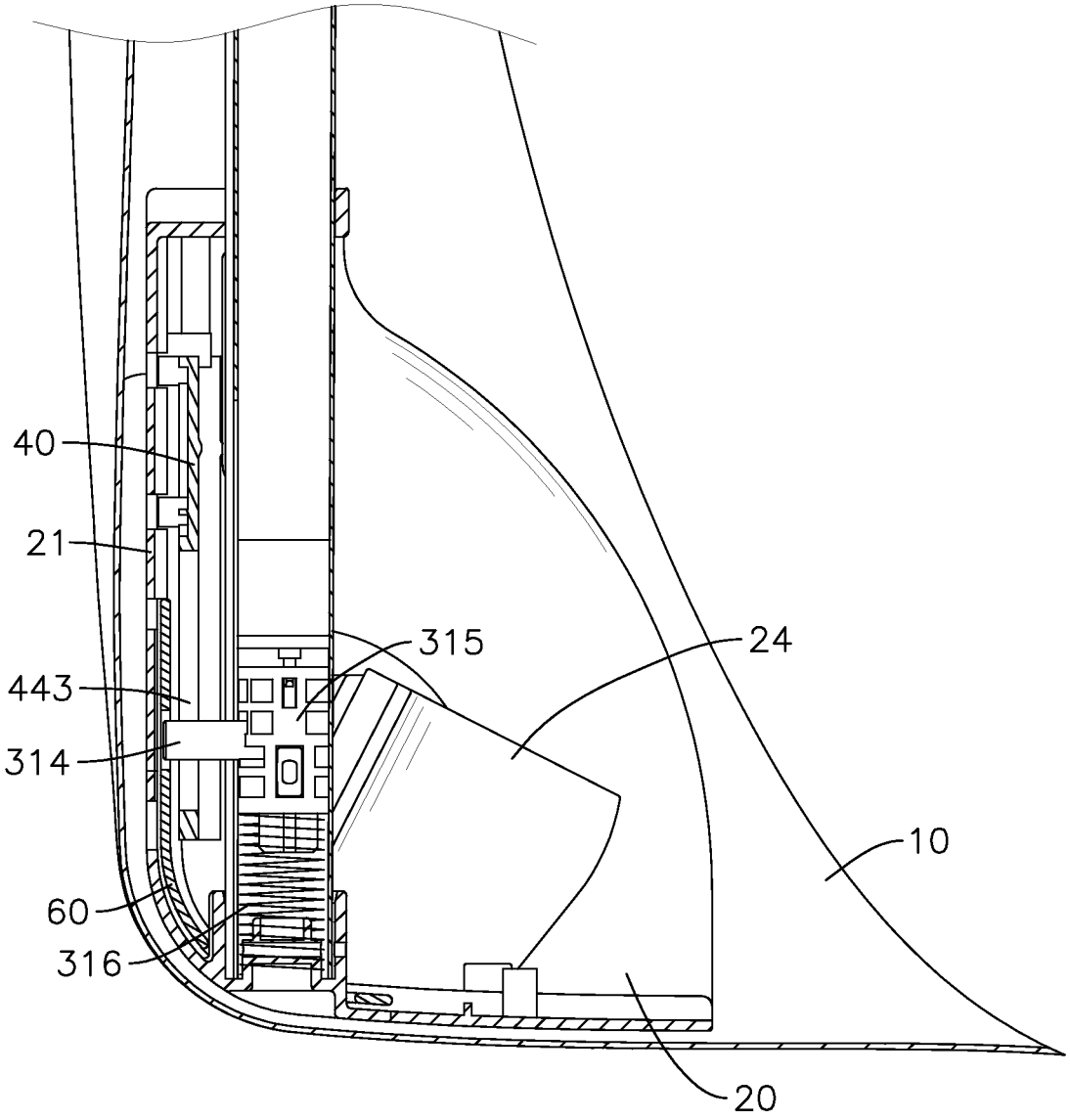
FIG. 14 is an enlarged cross-sectional side view of the retractable wheel mechanism of the suitcase in FIG. 13.
Figure 15:
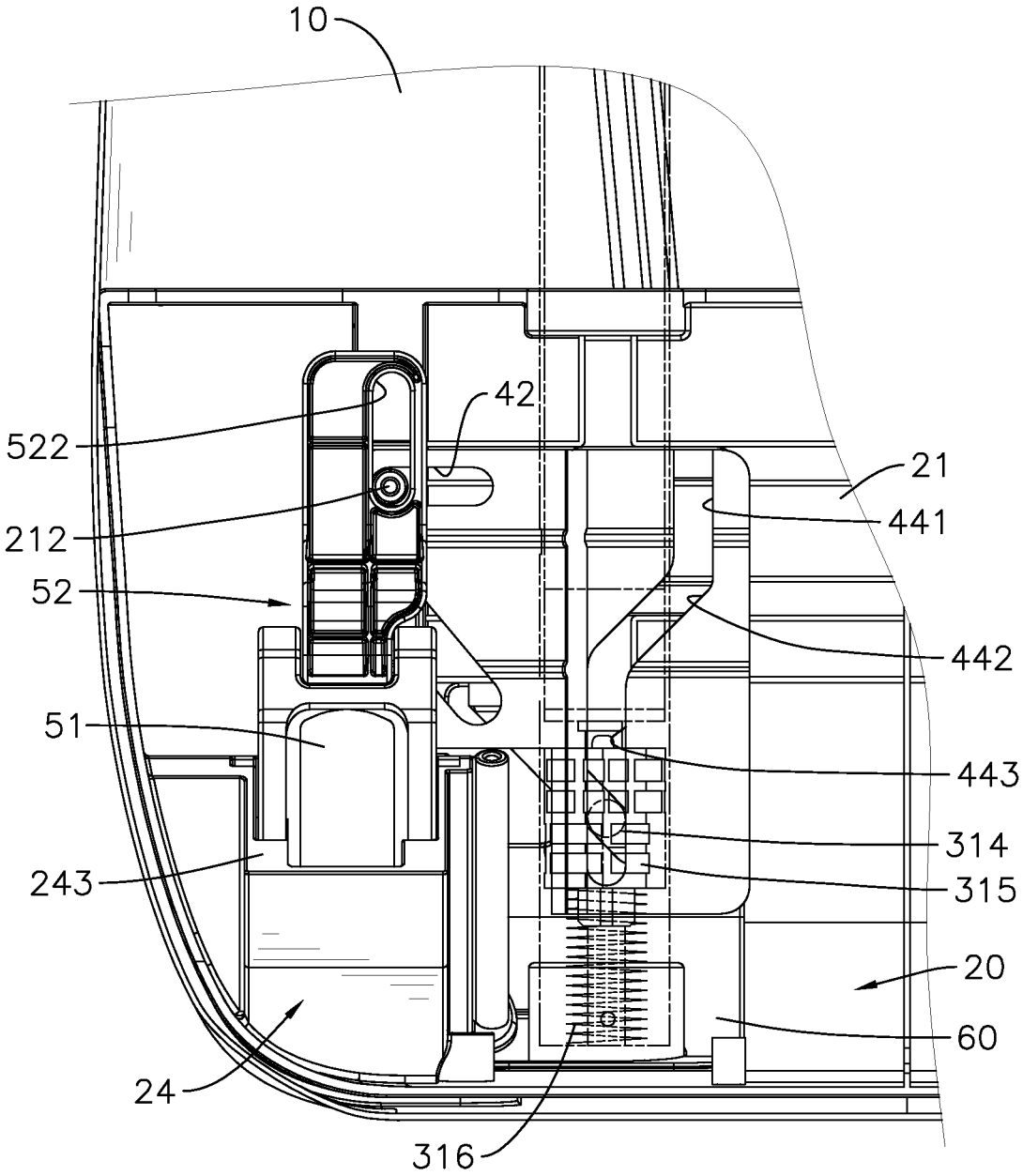
FIG. 15 is an enlarged schematic view of the retractable wheel mechanism of the suitcase in FIG. 13.

With reference to FIGS. 10, 11, and 12, when retracting the inner tubes 313 of the retractable rod assemblies 31 and the driving protrusion 314 of each of the retractable rod assemblies 31 slides into and along the shifting section 442 of the driven slot 44 of the corresponding slidable panel 40, the slidable panels 40 are driven to move transversely. For the timing being, the driven protrusion 523 of the connector 52 of each of the wheel sets 50 slides toward the upper end of the driving slot 43 of the corresponding slidable panel 40, and the guiding protrusions 521 of the connector 52 of each of the wheel sets 50 slide toward the upper ends of the wheel guiding slots 242 on the side walls 241 of the corresponding wheel storage portion 24. Accordingly, the wheel sets 50 are driven to be retracted into the wheel housing 20. Meanwhile, the wheel covers 60 still do not cover the through holes 23 of the wheel housing 20 and the openings 14 of the outer housing 10.

With reference to FIGS. 2, 13, 14, and 15, when the driving protrusion 314 of each of the retractable rod assemblies 31 further slides into and along the lower longitudinal section 443 of the driven slot 44 of the corresponding slidable panel 40, the driving protrusion 314 of each of the retractable rod assemblies 31 also slides in and along the driven slot 63 of the corresponding wheel cover 60. As the driving protrusions 314 of the retractable rod assemblies 31 slide toward the lower ends of the driven slots 63 of the corresponding wheel covers 60 respectively, the wheel covers 60 are driven to slide transversely and to cover the through holes 23 of the wheel housing 20 and the openings 14 of the outer housing 10.

The retractable wheel mechanism of the suitcase as described has the following advantages. By extending the retractable rod assemblies 31 of the retractable handle 30, the wheel sets 50 can be driven to protrude out of the outer housing 10. By shortening the retractable rod assemblies 31 of the retractable handle 30, the wheel sets 50 can be retracted and the wheel covers 60 can be driven to cover the openings 14 of the outer housing 10. Therefore, it is convenient to retract the wheel sets 50. An owner of the suitcase with the retractable wheel mechanism can retract the wheel sets 50 whenever he has to carry the suitcase without dirty his clothes, or whenever he has to pull the suitcase into an office or a room without revealing the dirty wheel 51. Moreover, when the wheel sets 50 are retracted, an appearance of the suitcase becomes a rectangular cuboid. Without the wheel sets 50 protruding out of the outer housing 10, the suitcase can be compactly stored in a closet.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A retractable wheel mechanism of a suitcase, the retractable wheel mechanism comprising:

a main housing having two openings and two wheel storage portions, and the two wheel storage portions separately defined in the main housing and corresponding in position to and communicating with the openings respectively;

a retractable handle mounted on the main housing and having two retractable rod assemblies, the retractable rod assemblies mounted through the main housing, and each of the retractable rod assemblies including a driving protrusion driven to slide longitudinally when the retractable rod assembly retracts or extends; and a restoring resilient element mounted in the retractable rod assembly and abutting against the driving protrusion;

two slidable panels mounted separately in the main housing, and respectively driven by the driving protrusions of the retractable rod assemblies to slide transversely; and two wheel sets respectively mounted in the wheel storage portions and respectively driven by the slidable panels to selectively be retracted in the main housing and protrude out of the main housing; and two wheel covers slidably mounted separately in the main housing, respectively corresponding in position to the slidable panels, and selectively covering the openings of the main housing respectively as well as covering the wheel sets in the wheel storage portions respectively.

2. The retractable wheel mechanism as claimed in claim 1, wherein the main housing includes an outer housing, wherein the two openings are separately formed through the outer housing; and a wheel housing securely mounted in an interior of the outer housing, wherein the two wheel storage portions are separately defined in the wheel housing;

the two retractable rod assemblies are mounted through the outer housing and protruding in the wheel housing; and the two slidable panels are mounted separately in the wheel housing.

3. The retractable wheel mechanism as claimed in claim 1, wherein each of the retractable rod assemblies includes an outer tube securely mounted in the main housing and having a longitudinal guide slot; and an inner tube slidably mounted in the outer tube and having an upper end protruding out of an upper end of the outer tube;

the driving protrusion of each retractable rod assembly is securely mounted on and protrudes from the inner tube, and protrudes through the longitudinal guide slot of the outer tube;

the restoring resilient element of each retractable rod assembly is mounted in the outer tube and the inner tube and has two ends respectively abutting against the main housing and the driving protrusion; and the retractable handle further has a grip securely connected to the upper ends of the inner tube.

4. The retractable wheel mechanism as claimed in claim 2, wherein each of the retractable rod assemblies includes an outer tube securely mounted in the outer housing and having a longitudinal guide slot; and an inner tube slidably mounted in the outer tube and having an upper end protruding out of an upper end of the outer tube;

the driving protrusion of each retractable rod assembly is securely mounted on and protrudes from the inner tube, and protrudes through the longitudinal guide slot of the outer tube;

the restoring resilient element of each retractable rod assembly is mounted in the outer tube and the inner tube and has two ends respectively abutting against the outer housing and the driving protrusion; and the retractable handle further has a grip securely connected to the upper ends of the inner tube.

5. The retractable wheel mechanism as claimed in claim 2, wherein the wheel housing further has multiple transverse guide slots;

each of the slidable panels has an inner side edge disposed next to the inner side edge of the other slidable panel;

an outer side edge disposed opposite to the inner side edge of the slidable panel;

at least one sliding protrusion, and each of the at least one sliding protrusion of the slidable panel protruding into a corresponding one of the transverse guiding slots of the wheel housing;

a driving slot formed in the slidable panel and extending obliquely; and a driven slot formed in the slidable panel and having an upper longitudinal section; and a shifting section extending obliquely down from a lower end of the upper longitudinal section, wherein the driving protrusion of a corresponding one of the retractable rod assemblies protrudes in the driven slot of the slidable panel each of the wheel sets has a wheel having a central rotating shaft; and a connector rotatably connected to the central rotating shaft of the wheel and having a driven protrusion, and the driven protrusion of the connector protruding into the driving slot of a corresponding one of the slidable panels.

6. The retractable wheel mechanism as claimed in claim 4, wherein the wheel housing further has multiple transverse guide slots;

each of the slidable panels has an inner side edge disposed next to the inner side edge of the other slidable panel;

an outer side edge disposed opposite to the inner side edge of the slidable panel;

at least one sliding protrusion, and each of the at least one sliding protrusion of the slidable panel protruding into a corresponding one of the transverse guiding slots of the wheel housing;

a driving slot formed in the slidable panel and extending obliquely; and a driven slot formed in the slidable panel and having an upper longitudinal section; and a shifting section extending obliquely down from a lower end of the upper longitudinal section, wherein the driving protrusion of a corresponding one of the retractable rod assemblies protrudes in the driven slot of the slidable panel each of the wheel sets has a wheel having a central rotating shaft; and a connector rotatably connected to the central rotating shaft of the wheel and having a driven protrusion, and the driven protrusion of the connector protruding into the driving slot of a corresponding one of the slidable panels.

7. The retractable wheel mechanism as claimed in claim 5, wherein the driven slot of each of the slidable panels further has a lower longitudinal section extending longitudinally down from a lower end of the shifting section and being parallel with the upper longitudinal section, and an upper end of the lower longitudinal section is connected and communicates with the lower end of the shifting section;

the retractable wheel mechanism further comprises two wheel covers slidably mounted separately in the wheel housing, respectively corresponding in position to the slidable panels and selectively covering the through holes of the wheel housing respectively, and each of the wheel covers has at least one sliding protrusion, and each of the at least one sliding protrusion of the wheel cover protruding into a corresponding one of the transverse guiding slots of the wheel housing; and a driven slot formed in the wheel cover, extending obliquely and formed through an upper edge of the wheel cover;

wherein when the driving protrusion of the corresponding retractable rod assembly slides to the lower longitudinal section of the driven slot of the corresponding slidable panel, the driving protrusion of the corresponding retractable rod assembly protrudes in and slides along the driven slot of the wheel cover.

8. The retractable wheel mechanism as claimed in claim 6, wherein the driven slot of each of the slidable panels further has a lower longitudinal section extending longitudinally down from a lower end of the shifting section and being parallel with the upper longitudinal section, and an upper end of the lower longitudinal section is connected and communicates with the lower end of the shifting section;

the retractable wheel mechanism further comprises two wheel covers slidably mounted separately in the wheel housing, respectively corresponding in position to the slidable panels and selectively covering the through holes of the wheel housing respectively, and each of the wheel covers has at least one sliding protrusion, and each of the at least one sliding protrusion of the wheel cover protruding into a corresponding one of the transverse guiding slots of the wheel housing; and a driven slot formed in the wheel cover, extending obliquely and formed through an upper edge of the wheel cover;

wherein when the driving protrusion of the corresponding retractable rod assembly slides to the lower longitudinal section of the driven slot of the corresponding slidable panel, the driving protrusion of the corresponding retractable rod assembly protrudes in and slides along the driven slot of the wheel cover.

9. The retractable wheel mechanism as claimed in claim 5, wherein each of the wheel storage portions of the wheel housing has two side walls separately disposed, each of the side walls having a wheel guiding slot, and the wheel guiding slot formed in the side wall, extending obliquely, and being parallel with the wheel guiding slot of the other side wall; and a wheel storage chamber defined between the two side walls, defined through the wheel housing, and communicating with the corresponding openings of the outer housing;

the two wheel sets are respectively mounted in the wheel storage chamber of the wheel housing;

the connector of each of the wheel sets includes a lower bracket rotatably connected to two opposite ends of the central rotating shaft of the wheel and having two guiding protrusions, and the two guiding protrusions of the lower bracket protruding into the wheel guiding slots on the side walls of the wheel storage portion respectively; and an upper bracket rotatably connected to the lower bracket, wherein a rotation axis of the upper bracket is parallel to the central rotating shaft of the wheel and the driven protrusion of the connector is formed on the upper bracket.

10. The retractable wheel mechanism as claimed in claim 8, wherein each of the wheel storage portions of the wheel housing has two side walls separately disposed, each of the side walls having a wheel guiding slot, and the wheel guiding slot formed in the side wall, extending obliquely, and being parallel with the wheel guiding slot of the other side wall; and a wheel storage chamber defined between the two side walls, defined through the wheel housing, and communicating with the corresponding openings of the outer housing;

the two wheel sets are respectively mounted in the wheel storage chamber of the wheel housing;

the connector of each of the wheel sets includes a lower bracket rotatably connected to two opposite ends of the central rotating shaft of the wheel and having two guiding protrusions, and the two guiding protrusions of the lower bracket protruding into the wheel guiding slots on the side walls of the wheel storage portion respectively; and an upper bracket rotatably connected to the lower bracket, wherein a rotation axis of the upper bracket is parallel to the central rotating shaft of the wheel and the driven protrusion of the connector is formed on the upper bracket.

11. The retractable wheel mechanism as claimed in claim 5, wherein the wheel housing further has multiple guiding protrusions separately protruding toward an interior of the wheel housing;

each of the slidable panels further has a transverse guide slot formed in the slidable panel;

the connector of each of the wheel sets further has a longitudinal guide slot formed through the connector and aligning with the transverse guide slot of a corresponding one of the slidable panel; and each guiding protrusions of the wheel housing protrudes in the transverse guide slot of a corresponding one of the slidable panels and the longitudinal guide slot of the connector.

12. The retractable wheel mechanism as claimed in claim 8, wherein the wheel housing further has multiple guiding protrusions separately protruding toward an interior of the wheel housing;

each of the slidable panels further has a transverse guide slot formed in the slidable panel;

the connector of each of the wheel sets further has a longitudinal guide slot formed through the connector and aligning with the transverse guide slot of a corresponding one of the slidable panel; and each guiding protrusions of the wheel housing protrudes in the transverse guide slot of a corresponding one of the slidable panels and the longitudinal guide slot of the connector.

13. The retractable wheel mechanism as claimed in claim 7, wherein each of the wheel covers further has a transverse guide slot formed through the wheel cover; and the outer tube of a corresponding one of the retractable rod assemblies is mounted through the transverse guiding slot of the wheel cover.

14. The retractable wheel mechanism as claimed in claim 8, wherein each of the wheel covers further has a transverse guide slot formed through the wheel cover; and the outer tube of a corresponding one of the retractable rod assemblies is mounted through the transverse guiding slot of the wheel cover.

15. The retractable wheel mechanism as claimed in claim 10, wherein a lower end of the wheel guiding slot of each of the side walls of each of the wheel storage portions extends toward the side board of the outer housing and an upper end of the wheel guiding slot of each of the side walls of each of the wheel storage portions extends to depart from the side board of the outer housing;

a lower end of the driving slot of each of the slidable panels extends toward the inner side edge of the slidable panel and an upper end of the driving slot of each of the slidable panels extends toward the outer side edge of the driving panel;

an upper end of the shifting section of the driven slot of each of the slidable panels extends toward the inner side edge of the slidable panel and is connected to and communicates with the lower end of the upper longitudinal section, and a lower end of the shifting section of the driven slot of each of the slidable panels extends toward the outer side edge of the slidable panel; and an upper end of the driven slot of each of the wheel covers is formed through the upper edge of the wheel cover and corresponds in position to the upper end of the lower longitudinal section of the driven slot of the corresponding slidable panel, and a lower end of the driven slot of the wheel cover extends to depart from the lower longitudinal section of the driven slot of the corresponding slidable panel.

16. The retractable wheel mechanism as claimed in claim 11, wherein a lower end of the wheel guiding slot of each of the side walls of each of the wheel storage portions extends toward the side board of the outer housing and an upper end of the wheel guiding slot of each of the side walls of each of the wheel storage portions extends to depart from the side board of the outer housing;

a lower end of the driving slot of each of the slidable panels extends toward the inner side edge of the slidable panel and an upper end of the driving slot of each of the slidable panels extends toward the outer side edge of the driving panel;

an upper end of the shifting section of the driven slot of each of the slidable panels extends toward the inner side edge of the slidable panel and is connected to and communicates with the lower end of the upper longitudinal section, and a lower end of the shifting section of the driven slot of each of the slidable panels extends toward the outer side edge of the slidable panel; and an upper end of the driven slot of each of the wheel covers is formed through the upper edge of the wheel cover and corresponds in position to the upper end of the lower longitudinal section of the driven slot of the corresponding slidable panel, and a lower end of the driven slot of the wheel cover extends to depart from the lower longitudinal section of the driven slot of the corresponding slidable panel.

* * * * *